United States Patent [19]

Stifter

[11] Patent Number: 4,626,005

[45] Date of Patent: Dec. 2, 1986

[54] FLUID-TIGHT FLEXIBLE CONNECTION BETWEEN HOLLOW SECTIONS

[76] Inventor: Gustav Stifter, Wanderhofstrasse 14, D-8922 Piting/Obb., Fed. Rep. of Germany

[21] Appl. No.: 627,421

[22] Filed: Jul. 3, 1984

[30] Foreign Application Priority Data

Jul. 6, 1983 [DE] Fed. Rep. of Germany ..... 3324406

[51] Int. Cl.[4] ..... F16L 39/00

[52] U.S. Cl. ..... 285/137.1; 285/397; 285/239; 285/925; 4/499

[58] Field of Search ..... 4/495, 499, 500, 501; 285/137 R, 397, 239, 398, 176, 175, DIG. 26

[56] References Cited

U.S. PATENT DOCUMENTS

| | | | |
|---|---|---|---|
| 2,798,745 | 7/1957 | Nelson | 285/137 R |
| 3,469,863 | 9/1969 | Riester et al. | 285/137 R |
| 3,590,855 | 7/1971 | Woollen | 285/137 R |
| 3,767,233 | 10/1973 | Hodge | 285/239 |
| 3,873,134 | 3/1975 | Sammaritano | 285/137 R |
| 4,156,540 | 5/1979 | Currie | 285/DIG. 26 |
| 4,160,465 | 7/1979 | Hsu | 285/DIG. 26 |
| 4,229,843 | 10/1980 | Belanger | 4/495 |
| 4,236,258 | 12/1980 | Batstone | 4/495 |
| 4,526,827 | 7/1985 | Stoll et al. | 285/137 R |

FOREIGN PATENT DOCUMENTS

| | | | |
|---|---|---|---|
| 2361725 | 6/1975 | Fed. Rep. of Germany . | |
| 2713793 | 10/1978 | Fed. Rep. of Germany . | |
| 2724287 | 12/1978 | Fed. Rep. of Germany . | |
| 2943366 | 4/1981 | Fed. Rep. of Germany . | |
| 1156031 | 6/1969 | United Kingdom | 285/137 R |

*Primary Examiner*—Thomas F. Callaghan
*Assistant Examiner*—Anthony Knight
*Attorney, Agent, or Firm*—Fitzpatrick, Cella, Harper & Scinto

[57] ABSTRACT

A fluid-tight flexible connection comprises couplings (27, 28) of soft elastic material, inserted in cavities (11) of hollow sections (12, 13), flexible parts (29) of soft elastic material arranged between the couplings, nipples (32) of hard material inserted in passages (33) of the couplings (27, 28) and in transverse passages (34) of the flexible parts (29), the nipples having barbs (40, 41) exerting an expanding action, and having an internal bore (39). The nipples (32) provide a fluid-tight connection between the several parts, namely the hollow sections (12, 13), the coupling parts (27, 28) and the flexible parts (29), which connection has a comparatively high tensile strength in the direction of the cavities (11) by virtue of the barbs. The adjoining hollow sections (12, 13) can hinge relative to each other owing to the elasticity of the flexible part (29), the maximum hinge angle being determined by the elasticity of the flexible part (29) and its length.

12 Claims, 17 Drawing Figures

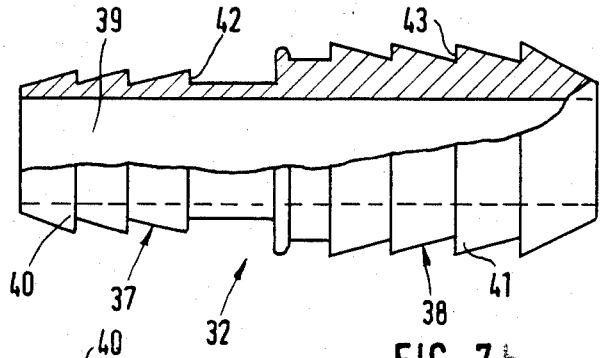
FIG. 7b
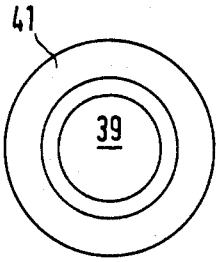
FIG. 7c
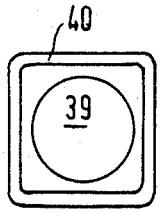
FIG. 7a
FIG. 6
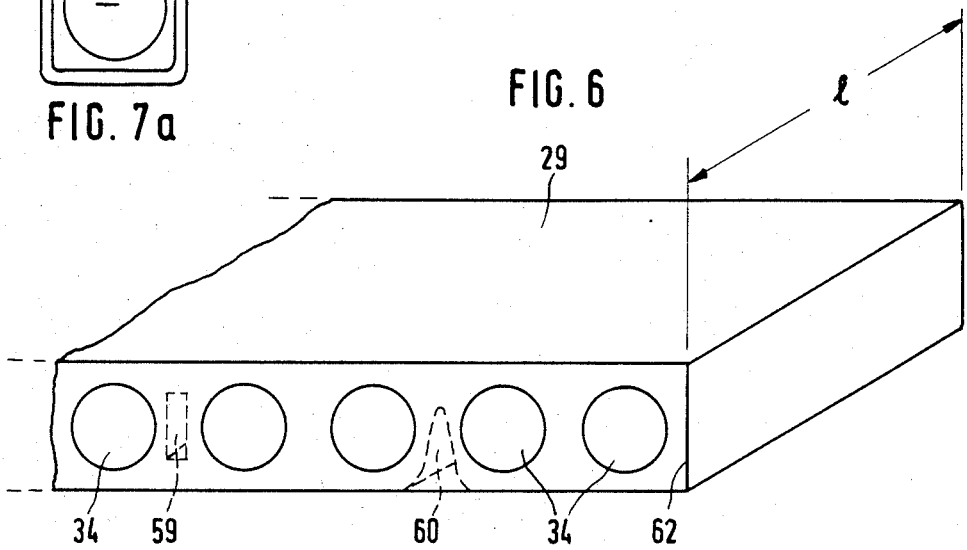
FIG. 8a
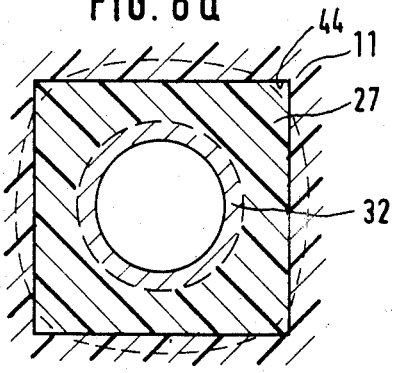
FIG. 8b
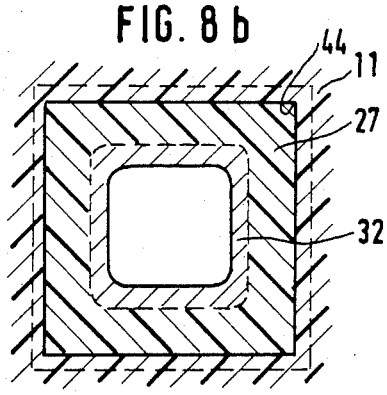

FIG. 9
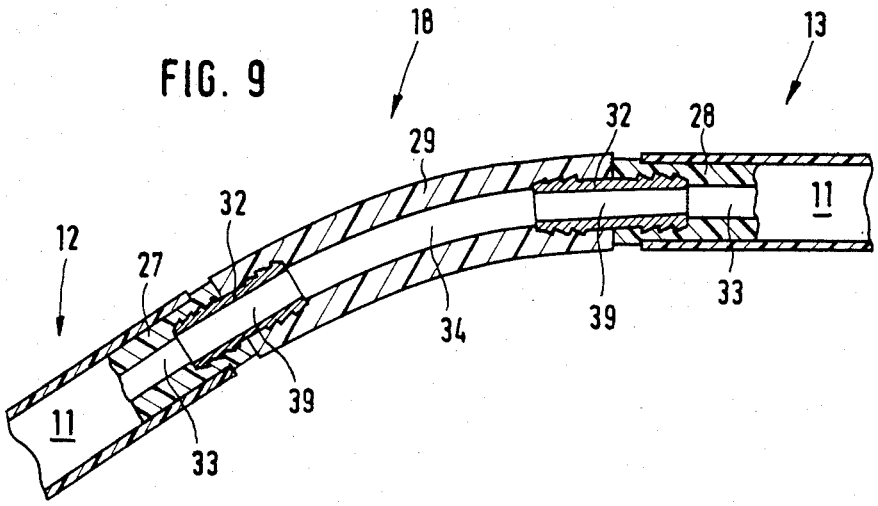
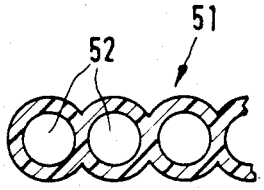
FIG. 10
FIG. 11
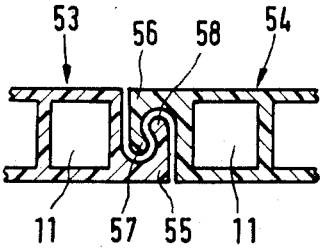

FLUID-TIGHT FLEXIBLE CONNECTION BETWEEN HOLLOW SECTIONS

The invention relates to a fluid-tight flexible connection between matching cavities of adjoining hollow sections, having couplings tightly insertable in a cavity or group of cavities with at least one passage in the direction of the cavities per hollow section, and having a flexible part capable of being introduced transverse to the extended direction of the cavities between the couplings to permit hinge action, likewise with at least one transverse passage aligned, in introduced condition, with the respective passages of the couplings.

The flexible connecting of adjoining hollow sections represents a problem of no small difficulty.

For example, a submersible and walkable cover for liquid tanks, in particular for swimming pools, comprising flexurally rigid hollow sections of synthetic material connected together and extending in one direction of extent of the tank, air being supplied at one end of the hollow sections in that direction of extent, has been disclosed (German Letters of Disclosure No. 2,943,366) where the cover floats on the surface of the liquid when filled with air and sinks to the bottom of the tank when the air is vented, and the hollow sections are multiply subdivided in the said direction of extent of the tank and flexibly connected to each other at the joints. As flexible connection external couplings tightly insertable in a cavity or group of cavities and having at least one passage in a the direction of the passages and flexible parts capable of being introduced thereinto transverse to the direction of extent to permit rotation, with at least one transverse passage aligned, in introduced condition, with the respective passage in the external couplings, were proposed, optionally with declivities for drainage of water.

In practice, however, it has turned out that these proposed flexible connections fail to ensure a fluid-tight seal to the outside, and moreover are too costly in manufacture to admit of their practical application.

For in the first place, the flexible connections must connect adjoining cavities and permit the passage of water and air; in the second place, they must be sealed from the outside; in the third place, the manufacturing tolerances must not be critical; in the fourth place, they must allow differential material displacements due to temperature or the like; and finally, they must withstand certain tensile loads that arise in practice and moreover be rapdily and economically assembled, and if necessary disassambled, even in the field.

Furthermore, they should not afford any opportunity for manipulation to occasional divers.

The flexible connection referred to failed to achieve a tight seal. Sealing with elastic tape or the like, as has likewise been proposed, is considered a dubious practice in the art, in particular for the additional reason that such a connection cannot be made under construction site conditions.

The attempt to achieve a tight connection by means of expansion lips or the like has failed because the webs between neighboring cavities are very thin, on the order of 0.5 mm. Hence a tight connection, strong in tension, was not attainable, the small thickness of the partitions leaving no room for projecting lips in an injection casting mold.

The object of the invention, then, is to provide a flexible connection, fluid-tight to the outside, inexpensive to manufacture and simple to install under conditions in the field.

This object is accomplished by the differentiating features of claim 1.

The features of the subsidiary claims are refinements of the invention.

At first glance, the idea of the invention, namely a multipartite configuration—two couplings, a flexible part, and single nipples connecting them, seems to violate the condition of simple and inexpensive assembly, since for each coupling, for example per running meter, about 50 nipples must be inserted. It turns out, however, that firstly the couplings and flexible parts and secondly the nipples as well can be simply manufactured. Further, a preassembly—insertion of the couplings in the cavities and introduction of the nipples into the passages of the couplings—can be completed in the shop. Field assembly is therefore limited essentially to slipping the flexible parts onto the nipples. In this way, the entire cover can be installed by simple means in any weather. Assuming that a swimming pool of 50×20 m will require about 1000 hollow section parts, and assuming a preparation time of 2 minutes per hollow section part, we have an assembly time of only two working days, unattainable for conventional swimming pool covers of comparable size. Although the flexible connection is achieved merely by insertion of parts one into another, the resulting connection is strong enough to be walked on without separating the parts connected. For repair purposes or major cleaning, however, the cover is very easily drawn up in the manner of a zipper—likewise a considerable advantage.

The invention will be further illustrated with reference to the embodiments shown in the drawing by way of example. In the drawings.

Figures 1, 2:
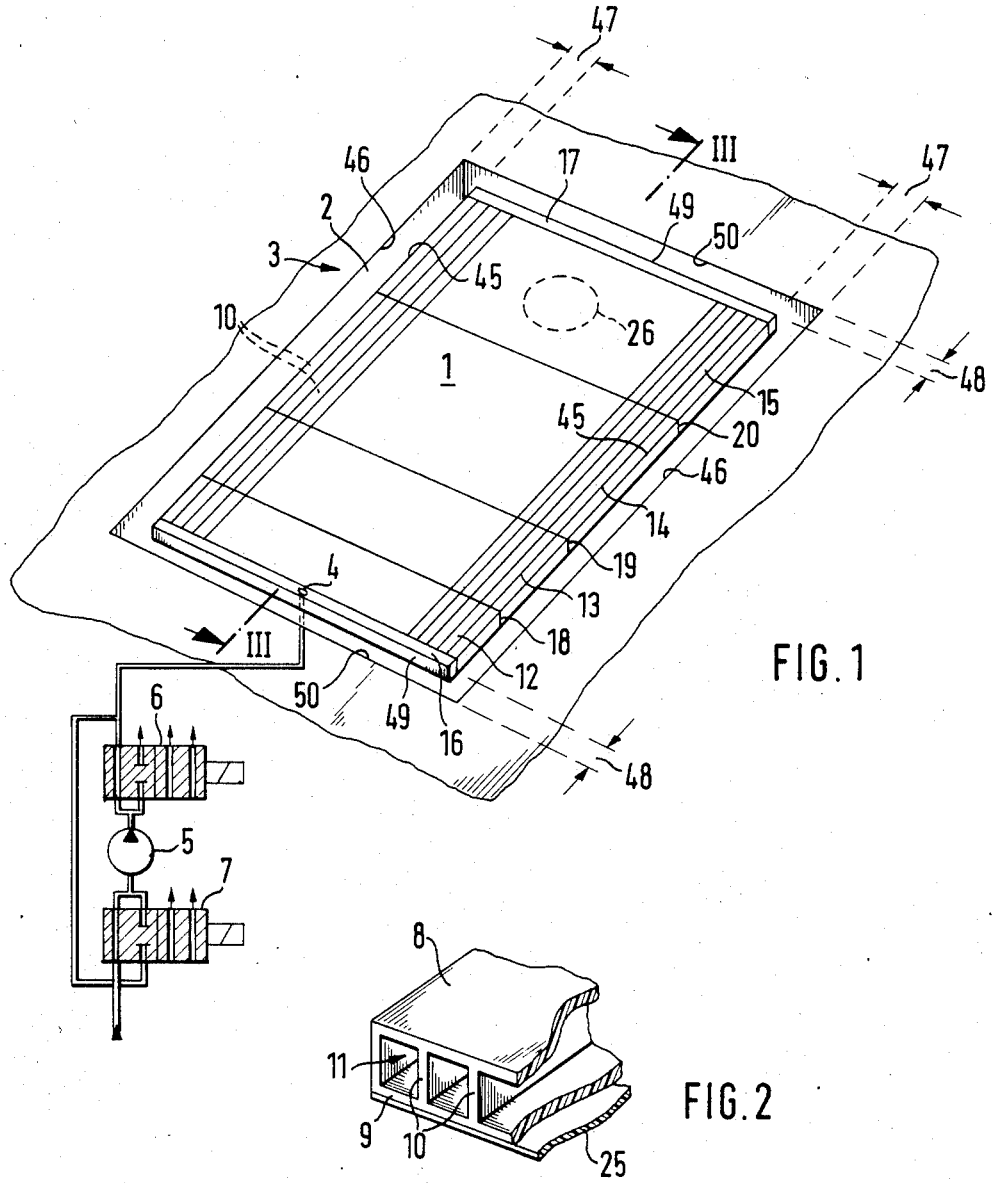
FIG. 1 shows a schematic pictorial view of a swimming pool cover using the flexible connection according to the invention.
FIG. 2 shows a pictorial partial section of one embodiment of a flexurally rigid hollow member to which the invention may be applied.

FIGS. 3*a* to 3*d* are schematic view to illustrate the operation of the cover according to FIG. 1.

Figure 4:
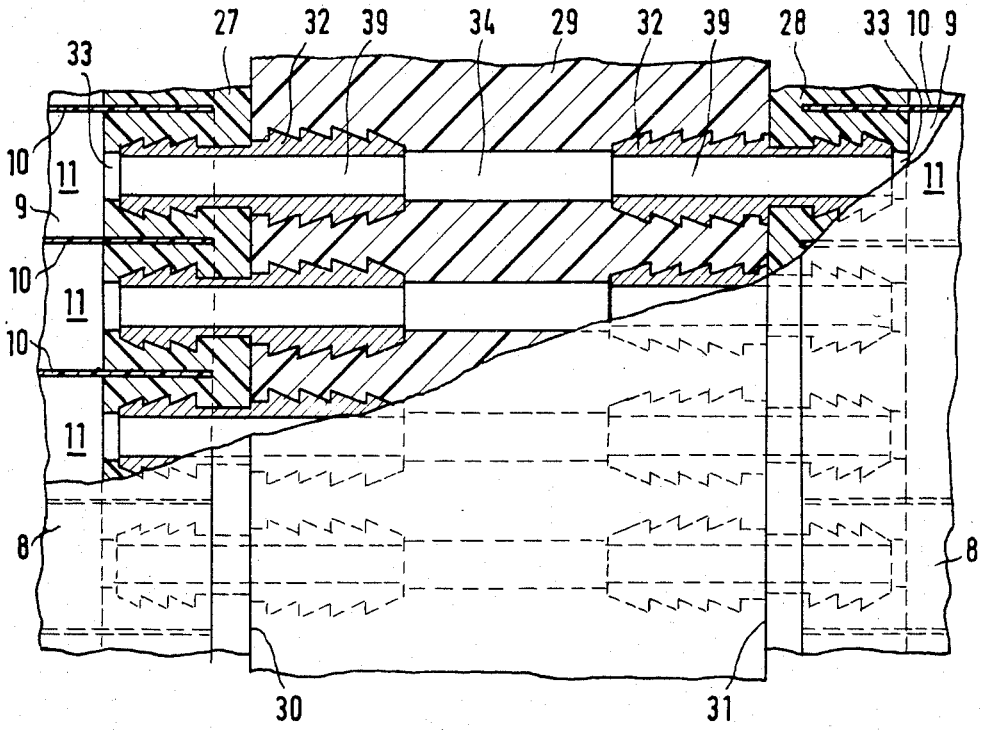

FIG. 4 is a schematic top view, in partial section, of a flexible connection according to the invention.

Figure 5:
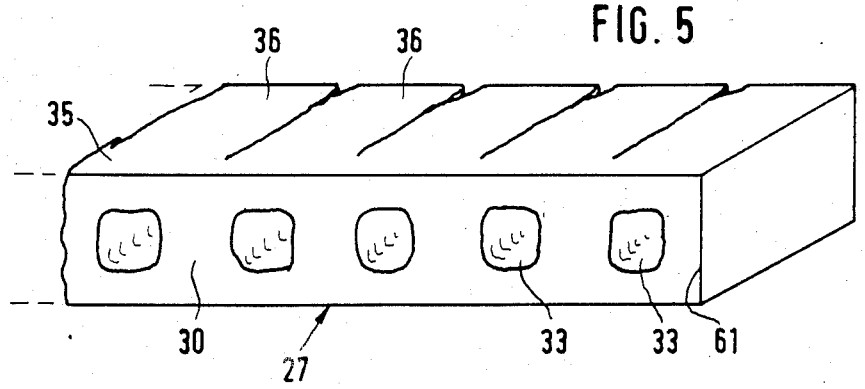

FIG. 5 is a pictorial elevation of a coupling.

FIG. 6 is a pictorial elevation of a flexible part.

FIGS. 7*a* to 7*c* are front, side and back views of a nipple.

FIGS. 8*a*, 8*b* schematically illustrate the significance of the cross sectional shape of the nipple.

FIG. 9 is a schematic side view of the flexible connection in hinged position.

FIG. 10 is a cross section of another embodiment of a hollow member.

FIG. 11 is an example of a possible way to connect hollow sections arranged side by side.

The invention will be illustrated in more detail with reference to its application to a submersible and walkable cover for liquid tanks, in particular swimming pools, according to GLD No. 2,943,366. However, the flexible connection may be used for other applications as well.

FIG. 1 pictorially shows a cover 1 floating on the water 2 in a swimming pool 3. Compressed air may be supplied to the cover 1 by way of a connection 4 by means of a pump 5, which may be a compressor. The pump 5 may alternatively be manually or pedal actuated. The kind of pump 5 to be used depends essentially on the size of the cover 1, and accordingly also on the size of the swimming pool 3. Air can be withdrawn from the cover 1 by way of the same connection 4 and pump 5 by reversing the pump 5 to suction. This may for example be done by means of the reversing system schematically shown, which consists of magnetic valves 6 and 7. Alternatively, however, some other form of pumping system with reversible direction of delivery may be provided. The cover 1 consists of hollow members such as are shown in section in FIGS. 2 and 10.

The hollow section of FIG. 2 consists of a top plate 8, a bottom plate 9 and webs 10 connecting them, forming cavities 11, rectangular in cross section (FIG. 2). As schematically indicated in FIG. 1, the webs 10 and hence the cavities 11 extend in one direction, preferably the lengthwise direction, of the swimming pool 3, the connection 11 being located at one end of the cavities 11.

As also indicated in FIG. 1, the cover 1 is composed of a plurality of hollow sections 12, 13, 14, 15 of varying length arranged in series, the hollow sections adjoining the connection 4 being shorter than the others. Length is here to be understood as the dimension in the direction of extent aforesaid. At the end of the cover 1 associated with the connection 4, the hollow section 12 has an air manifold 16, while at the other end of the cover 1, i.e. the end of the hollow section 15 away from the connection 4, a water manifold 17 is provided. The several hollow sections 12 to 15 are joined together, flexibly as well as water- and air-tight to the outside, by means of flexible connections 18, 19 and 20 respectively. The flexible connection 18, 19, 20 is such that communication is always maintained between the matching cavities 11 of adjoining hollow sections 12, 13, 14, 15.

With reference to FIG. 3, the lowering and raising of the cover 1 in the swimming pool 3 will next be illustrated. In the embodiment according to FIG. 3 for example, air is supplied to and withdrawn from the connection 4 inside the swimming pool 3 by way of a spiral duct 21, a depression 23 being provided in the bottom 22 of the swimming pool 3 to accommodate the spiral duct 21, FIG. 3*a* shows the condition with the cover 1 floating on the water 2. Here, as indicated by arrows, some air can be regularly supplied to the cover 1 in this condition by means of the pump 5 in order firstly to maintain a certain excess pressure of 1 to 2 mbar in the cavities 11 and secondly to be sure to remove any water having penetrated during submersion by flooding and left behind. This last is advantageous in particular when the cover 1 is to remain in the floating condition for considerable periods of time, for example in winter. Supplying small amounts of air is also expedient in particular if—as shown—apertures 24 are provided in the bottom of the water manifold 17, i.e. facing the surface of the water. For lowering, first the pump 5 is switched to suction, thereby continuously drawing water through the aperture 24 into the nearest hollow section 15. Then—as shown in FIG. 3*b*—this hollow section 15 inclines downward. The flexible connection 20 is so constructed that a maximum hinge angle $\alpha$ of about 30° can be attained. No later than when this hinge angle $\alpha$ is attained, or upon encountering the bottom 22, the water aspirated through the aperture 24 is drawn also through the flexible connection 20 into the next hollow section 14, which can attain the same maximum hinge angle $\alpha$ in relation to the next hollow section 13. Finally the water penetrates also into the hollow section 13, the second counting from the inlet 4, which can attain a maximum hinge angle $\beta$ of about 15° from the first hollow section 12, which is ultimately entered by water also, whereby the cover 1—as shown in FIG. 3*d*—is finally laid entirely on the bottom 22 of the pool 3. The spiral duct 21 is then completely retracted into the depression 23. The pump 5 may now be stopped. Alternatively, the pump 5 may be stopped automatically whenever water penetrates into a monitoring device of suitable type, not shown, between the inlet 4 and the pump 5.

Figure 3A:
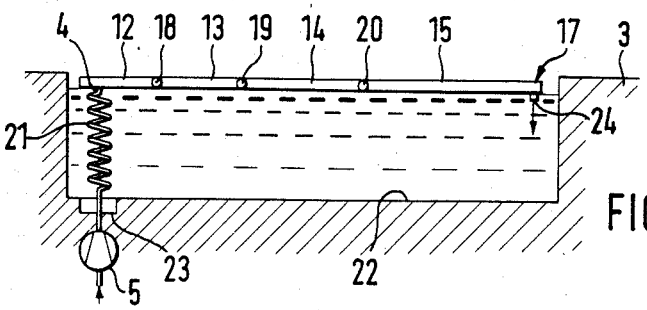
Figure 3B:
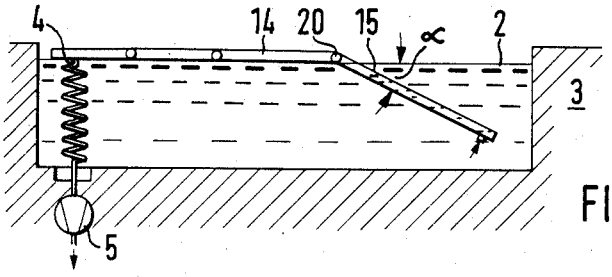
Figure 3C:
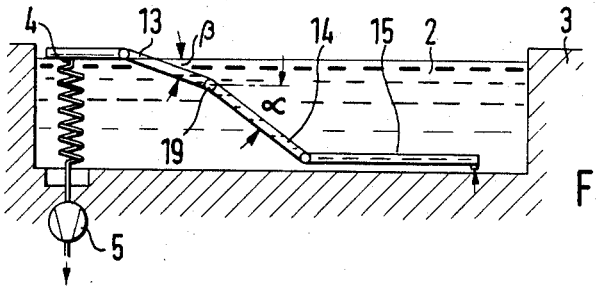
Figure 3D:
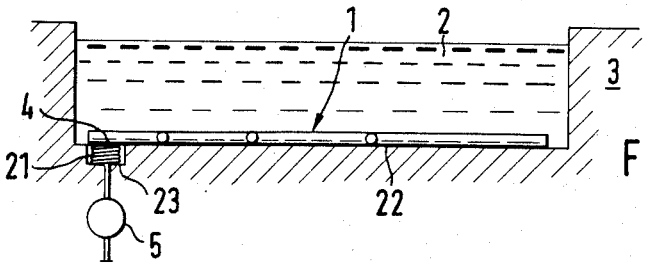

To raise the cover 1, the procedure is reversed, that is air is supplied to the cover 1 by means of pump 5 by way of the inlet connection 4, so that the cavities 11 of the several hollow sections 12, 13, 14, 15 are successfully filled with air and begin to swell up until the water has been completely expelled from the cover 1 by way of the outlet 24, so that the condition represented in FIG. 3*a* is reached. By the arrangement shown, each of the hollow sections 12, 13, 14, 15 at some time during the elevation reaches an inclined position in which the water can drain off with the help of the pressure of the air supplied.

A self-flooding cover 1 may also be obtained by disconnecting the pump 5 completely for lowering and venting air to the outside unhindered from the inlet 4. To initiate the lowering operation, of course, ballast must then be provided at the ends of the cover 1 corresponding to the water manifold 17.

Again, the apertures 24 may comprise completely or partially closable valves, so that the pump 5 after reaching the floating condition shown in FIG. 3*a* will keep on pumping only slightly until an excess pressure is generated, and then stop. Then, of course, the valves must be opened for flooding.

The arrangement shown in FIG. 3 with spiral duct 21 and recess 23 in the bottom 22 is feasible only if the recess is provided in the first place at the time of installation of a new swimming pool 3. The connection between the pump 5, if installed later, and the air manifold 16 of the first hollow section 12, i.e. the one having at least one inlet 4, is made from above, preferably by means of an elastic hose. The hose may be removed in lowered condition, for example by means of a pushbutton closure or the like. In the self-flooding type of cover 1, no valve is then required, since the cavities 11 are completely filled with water.

By means of the flexible connections 18, 19, 20 between hollow sections 12, 13, 14, 15, the float is effectively prevented from shooting out over the water level, as a rigid float might. A smooth emergence and elevation are achieved. Such a cover 1 floating on the water 2 of a swimming pool 3 provides excellent insulation of the water against heat losses, owing to the air space formed by the air-filled cavities 11. Furthermore, rain and in particular dust, leaves and snow are kept out of the swimming pool 3. Owing to the essentially rigid configuration of the cover 1, these encumbrances can easily be hosed away before lowering. In the lowered condition, there is no impediment to swimming activities, since the cover 1 is sufficiently rigid and can be walked upon. In swimming pools 3 with bottom drain-out an opening 26 is provided at the location thereof, its side walls sealed off from the interior of the cavities. In floating condition, this opening 26 may be stopped by a closure (not shown). Suitable materials for the cover 1 are hygienically acceptable synthetic materials resistant to chemicals contained in the water, for example chlorine or fluorine, such as hard PVC and acrylic glass.

The cover 1 may thus be made transparent if desired. Color effects may also be achieved. If the cover is coated on the under side with an absorbing film, like the absorbing film 25 in FIG. 2, the uptake of solar heat may be improved in floating condition especially. By suitable choice of material and/or suitable texturing of the top surface of the coverplate 8, the danger of slipping when walking on the cover 1 may even be lessened compared to walking directly on the bottom, in addition to a more comfortable standing or walking surface.

A special problem is presented by the flexible connections 18, 19, 20 between matching cavities 11 of adjoining hollow sections 12, 13; 13, 14; 14, 15, since in the first place the flexible connection is to be fluid-tight to the outside, in the second place simple to manufacture, and finally easy to assemble.

An embodiment of the flexible connection according to the invention will now be illustrated in more detail with reference to the flexible connection 18.

It consists essentially of a first coupling 27 capable of being inserted in the cavities 11 of the hollow section 12, a second coupling 28 capable of being inserted in the cavities 11 of the adjoining hollow section 13 and of essentially the same conformation as the coupling 27, a flexible part 29 between the facing ends 30 and 31 of the two couplings 27 and 28 respectively, and nipples 32 inserted in the pairs of colinear passages 33 in the respective coupling and the transverse through passages 34 of the flexible part 29.

Although a separate coupling may be provided for each of the cavities 11, it is advantageous to provide a one-piece coupling 27 or 28 for at least a group of cavities 11 of a hollow section 12 or 13, as shown by way of example in FIG. 5. The coupling 27 (or 28) need not necessarily extend over all the cavities 11 of a hollow cube 12 or 13.

As FIG. 5 shows, such a coupling 27 has a common part 35 emanating from one end 30 and adjoining separate nozzles 36 matching the array of cavities 11 in the hollow section 12, each passage 33 traversing the common part 35 and, more or less centrally, one of the nozzles 36. The outside dimensions of the nozzles 36 in cross sectional direction here substantially correspond to the inside dimensions in cross sectional dimension of the associated cavity 11; they are preferably slightly larger, but may instead be of the same size or slightly smaller. It is necessary only that the nozzles 36 of the coupling 27 be simply insertable in the cavities 11.

The coupling 27 consists of a soft elastic, in particular rubber-elastic material, such as a plastic, preferably with a Shore hardness of about 70 to 75. The material is impermeable to the fluids involved in the application, water and air in this case, and is resistant to the fluids as well, i.e. is not attacked in particular by the substances dissolved in the pool water, such as chlorine and fluorine. Preferably it is likewise resistant to aging by solar radiation and environmental influences.

It is also of advantage if the material used for the coupling 27 will swell somewhat when exposed to the pool water, thus permitting better contact and hence adhesion of the nozzles 36 of the coupling 27 with and to the walls of the cavities 11 in question.

FIG. 6 shows a flexible part 29. Like the coupling 27 (or 28), the flexible part 29 may extend over several neighboring cavities 11 of the associated hollow sections 12, 13, and accordingly have a corresponding number of transverse passages 34 which of course are formed in the same pitch and array as the cavities 11 of the hollow section 12 and 13. Of course, as in the case of the coupling 27 (or 28), the flexible part 29 may extend over only some of the cavities 11 of the cover 1.

The material of the flexible part 29 is subject to much the same requirements as have been mentioned for the material of the couplings 27 (or 28), except that it is advantageous if the Shore hardness of the flexible part 29 is between about 45 and 60, so that the flexible part 29 is softer and/or more elastic.

FIG. 7 shows a nipple 32 suitable for connecting couplings 27, 28 to the flexible part 29. FIG. 7*b*, showing the nipple 32 in side view, shows also that it consists essentially of two portions 37 and 38. The portion 37 is insertable in the passages 33 of the couplings 27 or 28, and the portion 38 is insertable in the transverse passages 34 of the flexible part 29. The nipple 32 has a conduit 39 permitting fluid communication between the cavity 11 and the transverse passage 34 by way of the passage 33, and hence by way of the next nipple 32 with the cavity 11 of the adjoining hollow section, as will be readily apparent from FIG. 4. On the outside, each of the portions 37, 38 has expanding features, which in the embodiment shown by way of example consists of sawtooth barbs 40 and 41 respectively, annularly encircling the respective portions 37, 38, with the steep flanks 42 and 43 of barbs 40 and 41 of portions 37 and 38 respectively facing each other. As a result of this, the nipple 32 is very easily thrust into the passage 33, or into the transverse passage 34, but very difficult to pull out again, for the additional reason that the exterior cross section (not counting barbs) of portions 37 and 38 is greater than the interior cross section of the corresponding passage 33 in coupling 22, or the transverse passage 34 in the flexible part 29. Hence (cf. FIG. 8), when the nipples 32 are forced into the passages 33 and 34, an expanding action and with it a compression towards the outside are exerted on the coupling 27 or flexible part 29 as the case may be. Since this expanding effect does not act against any force applied from the outside in the case of the flexible part 29, preferably the outside diameter at least of the barbs 41 of the corresponding portion 38 compared to the transverse passage 34 is definitely greater than the outside diameter of the barbs 40 of the other portion 37 compared to the passage 33 of the coupling 27, 28.

As shown, the invention will be further illustrated by an example in which the cavities 11 are rectangular in cross section (cf. FIG. 2). Now if the passage 33 in the nozzle 36 and the cross section of the portion 37 of nipple 32 are substantially circular in cross section, then (cf. FIG. 8*a*) the expansion pressure exerted by the nipple 32, or its portion 37, may not suffice to exert an expanding action into the corners of the cavity 11; it may even happen that the nozzle 36 will be pulled out of the corners 44. In other words, tightness cannot always be assured. This problem is solved by matching the cross sectional profile of the passage 33 as well as the cross sectional profile of the periphery of the portion 37 of nipple 32 to the cross section of the cavity 11, as indicated in FIGS. 5 and 7*a*. The expansion pressure thus acts also into the corners 44 (cf. FIG. 8*b*) of the cavity 11. The effect of the expanding pressure exerted by the inserted nipple 32 is indicated by dotted lines in FIGS. 8*a* and 8*b*.

In installed condition (cf. FIGS. 4 and 9), the two hollow sections 12 and 13 may now be hinged on the flexible connection 18. While the nipples 32 are hardly shifted out of their position of alignment with the cavity 11, the flexible part will bend by virtue of its own elasticity, about an axis parallel to the array of adjacent cavities 11. By virtue of the inherent elasticity of the couplings 27, 28, and of the flexible part 29, furthermore, the tight seal from the outside is maintained, and fluid communication is maintained by way of the passages 33, 39 and 34. The inherent elasticity is backed up by the one-piece design of couplings 27, 28 and flexible parts 29 for a plurality of adjacently arranged cavities 11 in a special way such that flow communication between adjoining cavities 11, specifically by way of the transverse passage 34, is not impaired, although a soft elastic material is used.

From the foregoing explanation it will be seen that the hinge angle between adjoining hollow sections 12, 13, and between other adjoining hollow sections 13, 14 and 14, 15, can be determined by the length l, with regard to the elasticity of the flexible part 29. For given material, with shorter length the hinge angle between adjoining hollow sections 12, 13; 13, 14; 14, 15 becomes less.

An essential advantage of the fluid-tight flexible connection constructed according to the invention is that assembly is extremely simple, and can be carried out in the field, as is especially advantageous in the case of hollow sections of large area. In practice, first the portions 36 of couplings 27 (or couplings 28) are inserted in the cavities 11. Then the nipples 32, by their portion 37, are inserted in the corresponding passages 33 of the coupling 27—a simple matter, since the flat flanks of the barbs are operative. The same procedure is applied to the cavities 11 of the other hollow section. Then the flexible part 29 is slipped by its transverse passages 34 over the portions 38 of the corresponding nipples 32, for each of the two hollow sections 12, 13—likewise an easy matter, since again the flat flanks of the barbs 41 are operative. Thus the barbs in each instance exert their expanding action, so that a firm connection is made between the couplings 27, 28 and the hollow sections 12, 13 on the one hand, the nipples 32 and the couplings 27, 28 on the other hand, as well as between the nipples 32 and the flexible part 29. This connection is moreover fluid-tight. If the couplings 27, 28 and the flexible part 29 consist of a material that will swell somewhat upon contact with one of the fluids, in this case swimming pool water, the spreading action is further enhanced in use. In practice, there is no danger that tensile stresses acting in the direction of the passages may detach the elements of the flexible connection from each other and thereby also disconnect the cavities from each other. Such loads can occur only under traffic or when the cover is being raised or lowered. No other tensile stresses occur.

Nevertheless, for repair purposes or major cleaning for example, it is possible to separate the hollow sections 12 from each other in simple manner without applying much force, namely by pulling coupling 27 or 28 and flexible part 29 apart in the manner of a zipper from one side, in the transverse extent of the cover 1.

Thus it turns out that a flexible connection constructed according to the invention will not only afford secure fluid-tight flexible communication achieved in a simple manner; it turns out that the flexible connection can be made in the field, i.e. at the construction site, can be simply taken apart again, and is moreover economical, especially since commercially available nipples may serve for the nipples. The nipples then consist of a commercial, comparatively hard material, in particular likewise a plastic.

The flexible connection is not applicable to hollow sections like that in FIG. 2 alone. The flexible connection may be used also for hollow sections of other cross sectional shape, for example also for a hollow section 51 as represented in FIG. 10, consisting of tubes arranged side by side and integral with each other, so that the cross sections of the cavities 52 are circular. Then, of course, the cross-sectional shape of the portion 37 of the nipple 32 will be correspondingly circular. Of course, still other cross sectional shapes are possible, an important factor in the choice for a given application being whether, in a swimming pool cover, the hollow sections are to be walkable in the condition of resting on the bottom or not.

Further, the flexible connection according to the invention is applicable also to an arrangement of hollow sections as represented by way of example in FIG. 11. A cover should in fact be usable for any pool size, although there are manufacturing limitations in the case of especially wide pools, since hollow sections are not generally available in outsize widths. Therefore the hollow sections 12 to 15, in a special embodiment, may be formed by arranging prefabricated hollow section parts 53, 54 side by side. As shown in FIG. 11, the hollow section parts 53, 54 arranged side by side may be connected together in substantially a flexurally rigid but detachable manner by means of angle flanges 55, 56 provided at the appropriate edges. Especially advantageous are elastically interlocking beads 57 and 58 on the angle flanges 55 and 56. These angle flanges 55, 56 may alternatively be hollow (not shown). Then hollow sections 12 to 15 of any width can be made up very quickly, and repairs can be done very quickly also.

In particular, all parts can be supplied prefabricated to the site and be field-assmbled in simple manner. In such an application, it is advantageous if the couplings 27, 28 and the flexible parts 29 are each matched in their widthwise extent to one of the hollow section parts 53 and 54 respectively, i.e. have a corresponding number of passages 33 or transverse passages 34 respectively. Alternatively, of course, a lap connection is possible, in which case the spacing of adjoining cavities 11 of neighboring hollow section parts, i.e. the size of the interlock 55 to 58 of the hollow section parts, must be allowed for.

To supplement the text referring to FIG. 1, be it noted also that the rate of sinking and the rate of rising of the cover 1 is determined not only by the output of the pump 5 but also by the extent to which the water can flow down or up between the edge 45 of the cover 1 and the edge 46 of the swimming pool 3. Likewise dependent on the size of the cover 1 are more or less pronounced contractions and expansions of the material of the cover 1 (as well as of the hollow sections 12, 13, 14, 15 and flexible connections 18, 19, 20). Thus a clearance 47 must be provided on both sides of the cover 1 between the edge 45 of the cover 1 and the edge 46 of the swimming pool 3. A similar clearance 48, but only because of the contractions and expansions of the material, must be allowed between the ends 49 of the cover 1 and 50 of the swimming pool 3. Now while the differences in size due to the clearances 47 and 48 are comparatively non-critical when the cover 1 is resting on the bottom 22, they may interfere with the shielding by the cover 1 when afloat. Experiments have shown that with a pool width of about 4 m, the clearance 47 should be about 8 to 10 cm. Besides, the clearance 47 is advantageous because cleaning tools such as bottom vacuums can be used even when the cover is floating and conveniently travel along the edge of the pool, and allowance can be made for fixed installations as well.

In practice, then, numerous nipples 32 are introduced side by side into the couplings 27, 28 and particularly into the flexible part 29, the outside dimension of the nipples 32 being somewhat greater than the inside dimension of the corresponding passages 33, 34. Owing to the inherent elasticity and hence compressibility of the material used, it is difficult, at least in the case of the flexible part 29, to insert all nipples 32 consecutively in the transverse passages 34, because the material surrounding the transverse passages 34 must yield. It is therefore advantageous, as indicated by dotted lines in FIG. 6, to provide through expansion passages 59 and/or through expansion grooves 60 between adjacent passages 34, or at least between pairs of adjacent passages 34. Then the material surrounding the passages 34 can yield, and all the nipples 32 can be introduced without difficulty.

If a larger number of adjoining cavities 11 are matched and are to be connected together by means of the connection according to the invention, it may happen in practice that even under a comparatively small applied force, flexible part 29 and couplings 27, 28 may be pulled far enough apart at the edge so that in the manner of a zipper, the whole assembly can be gradually undone beginning at the edge. For example, this may happen when a very wide swimming pool cover, submerged and lying on the bottom, is walked upon. At least in such a case, it is desirable if the marginal nipples 32 are bonded into the corresponding parts (couplings 27, 28 and flexible part 29), which may be done in the field, and/or if in such a case the couplings 27, 28 and flexible part 29 are bonded together at their (extreme) margins, which may be done in the field likewise. Such margins 61 and 62 are indicated in FIGS. 5 and 6 respectively. If the nipples 32 are to be bonded in, they are bonded into the passages 33 or 34 adjacent to the said margins 61 and 62 respectively.

Of course, many other embodiments of the flexible connection according to the invention are possible.

I claim:

1. A fluid-tight flexible connection connecting matching cavities of adjoining hollow sections, said connection comprising at least two couplings each tightly inserted into a cavity of a different one of said hollow sections with at least one passage extending into the cavity in the respective hollow section, a flexible part extending between the couplings to permit a hinge action between said adjoining hollow sections upon bending of said flexible part, said flexible part having at least one transverse passage aligned with the respective passages of the couplings, each coupling being of a soft elastic material, with its external cross section being tightly fitted in the internal cross section of the cavity, the flexible part itself being of a soft elastic material, and tubular nipples of hard material and forced into the aligned matching passages of an associated coupling and the transverse passage of the flexible part.

2. A connection according to claim 1, wherein each coupling is formed of a rubber-elastic synthetic material.

3. A connection according to claim 1 wherein each coupling has a shore hardness of about 70 to 75.

4. A connection according to claim 1 wherein each flexible part is formed of a rubber-elastic synthetic material.

5. A connection according to claim 1 wherein each flexible part is formed of a material having a Shore hardness of about 45 to 60.

6. A connection according to claim 1 wherein each coupling is one of a group of couplings united in a single one-piece fitting.

7. A connection according to claim 1 wherein the cross section of the passage in each coupling and the external cross section of the portion of the nipple inserted in the passage substantially correspond in profile to that of the cavity of the adjoining hollow section.

8. A connection according to claim 1 wherein the tubular nipples are formed at each end with external annular barbs with a sawtooth profile, the steep flanks of the barbs on the two ends of one nipple facing each other.

9. A connection according to claim 1 wherein said couplings, said flexible part and said nipples are resistant to chemicals contained in swimming pool units.

10. A connection according to claim 1 wherein the material of the coupling swells on contact with a fluid passing therethrough.

11. A connection according to claim 1 wherein the flexible part is formed with expandable passages between neighboring transverse passages.

12. A connection according to claim 1 wherein the marginal nipples are bonded to said couplings and to said flexible part and wherein said couplings and flexible part are bonded together at their extreme margins.

* * * * *